US009003685B1

(12) United States Patent
Huang

(10) Patent No.: US 9,003,685 B1
(45) Date of Patent: Apr. 14, 2015

(54) HINGED TRIGGER GUARD

(71) Applicant: George Huang, Henderson, NV (US)

(72) Inventor: George Huang, Henderson, NV (US)

( * ) Notice: Subject to any disclaimer, the term of this patent is extended or adjusted under 35 U.S.C. 154(b) by 0 days.

(21) Appl. No.: 14/010,677

(22) Filed: Aug. 27, 2013

(51) Int. Cl.
*F41A 17/00* (2006.01)
*F41A 17/54* (2006.01)

(52) U.S. Cl.
CPC ..... *F41A 17/54* (2013.01)

(58) Field of Classification Search
USPC ..... 42/70.07, 71.01, 72
See application file for complete search history.

(56) References Cited

U.S. PATENT DOCUMENTS

| | | | | |
|---|---|---|---|---|
| 4,499,683 | A * | 2/1985 | Savioli | 42/69.01 |
| 4,685,379 | A * | 8/1987 | Troncoso | 89/136 |
| 5,225,610 | A * | 7/1993 | Uria | 42/40 |
| 5,235,771 | A * | 8/1993 | Sokol et al. | 42/105 |
| 5,305,539 | A * | 4/1994 | Von Kuster | 42/75.01 |
| 5,726,377 | A * | 3/1998 | Harris et al. | 89/191.01 |
| 5,827,992 | A * | 10/1998 | Harris et al. | 89/191.01 |
| 6,347,622 | B1 * | 2/2002 | Hsueh | 124/49 |
| 6,434,874 | B1 * | 8/2002 | Hines | 42/74 |
| 7,000,345 | B1 * | 2/2006 | Kay | 42/75.02 |
| 7,010,879 | B2 * | 3/2006 | Olson | 42/105 |
| 7,076,902 | B2 * | 7/2006 | Hengstenberg et al. | 42/51 |
| 2005/0183317 | A1 * | 8/2005 | Finn | 42/72 |

* cited by examiner

*Primary Examiner* — Michelle R Clement
(74) *Attorney, Agent, or Firm* — Shaddock Law Group, PC

(57) ABSTRACT

A hinged trigger guard having a base member that includes a base member body portion; a base member projection extending from the base member body portion and having a base member aperture formed therethrough; an extension member that includes an extension member body portion; two ears extending from the extension member body portion, wherein an extension member recess is defined between at least a portion of the ears, and wherein an extension member aperture is formed through each of the ears. An extension member projection extends from the extension member body portion. The extension member is pivotably attached to the base member when the base member aperture is aligned between the extension member apertures and a pivot/installation pin is positioned within the aligned extension member apertures and base member aperture.

18 Claims, 6 Drawing Sheets

HINGED TRIGGER GUARD

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present invention relates to firearm trigger guard.

2. Description of Related Art

Various firearms and other devices have triggers or actuator buttons that are protected from inadvertent or accidental manipulation by being positioned within trigger guards. One such firearm is the AR-15.

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

The exposed portion of the AR-15's trigger is positioned within a trigger guard aperture of the AR-15's lower receiver. Typically, and particularly with forged lower receivers, the trigger guard aperture, when viewed from a side of the receiver, surrounds the exposed trigger on three sides. A one-piece trigger guard is typically installed to protect the exposed trigger from the open, bottom side.

The standard trigger guard is typically held in place by a pivot/installation pin being installed in a rear aperture of the trigger guard and a ball plunger or screw maintaining the front of the trigger guard in position.

In order to expand the area of the trigger guard aperture, to allow, for example, a gloved finger access to the trigger, the ball plunger or screw can be manipulated so as to allow the trigger guard to pivot on the pivot/installation pin. However, in order to allow sufficient space for the one-piece trigger guard to pivot, a gap is typically present between the pistol grip/lower receiver and the rear of the trigger guard.

Various devices have been created in an attempt to minimize or remove the gap between the rear of the trigger guard and the pistol grip/lower receiver. One solution has included positioning a piece of substantially rigid rubber within the gap. Another solution has been to create trigger guards that completely fill the recess in the lower receiver for receiving the rear portion of the trigger guard. Yet another solution is to create a pistol grip that extends to cover the gap between the lower receiver and the trigger guard.

Unfortunately, all of the known solutions result in a trigger guard that cannot be folded or pivoted to expand the trigger guard aperture.

Any discussion of devices, documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

The two-piece, hinged trigger guard of the present invention provides a trigger guard that eliminates the traditional gap between the pistol grip/receiver and the trigger guard, while still allowing the trigger guard to be pivoted or folded to allow additional access to the trigger guard aperture.

In various exemplary, non-limiting embodiments, the hinged trigger guard of the present invention comprises a base member and an extension member, wherein the extension member is pivotably attached, via a pivot/installation pin, to the base member.

In various exemplary, non-limiting embodiments, the base member includes a base member body portion and a base member projection that extends from the base member body portion. A base member aperture is formed through the base member projection. The base member is formed so that at least a portion of the base member can be fitted within the recess formed between the ears located towards the rear of a trigger guard aperture of a firearm's lower receiver.

The extension member includes an extension member body portion and two ears. Each of the ears extends from the extension member body portion such that an extension member recess is defined between at least a portion of the ears. An extension member aperture is formed through each of the ears. The extension member recess is formed so that the base member projection is capable of being received within at least a portion of the extension member recess.

An extension member projection extends from the extension member body portion. The extension member projection is formed so that at least a portion of the extension member projection can be fitted within the recess formed between the ears located towards the front of a trigger guard aperture of a firearm's lower receiver.

The extension member is pivotably attached to the base member when the base member aperture is aligned between the extension member apertures and a pivot/installation pin is positioned within the aligned extension member apertures and base member aperture.

In various exemplary, non-limiting embodiments, the extension member projection extends from one end of the extension member body portion while the ears extend from an opposite end of the extension member body portion.

In various exemplary, non-limiting embodiments, the hinged trigger guard further comprises a ball plunger extending from the extension member projection, and generally extending from a side wall of the extension member projection. In various exemplary embodiments, the ball plunger comprises a ball and a spring biasing element. The spring biasing element is maintained within a recess formed in the extension member projection and the spring biasing element provides a biasing force to the ball.

When the extension member is pivotably attached to the base member, the degree of pivot or range of movement of the extension member relative to the base member is limited by interaction of the base member projection and the extension member recess.

Accordingly, the presently disclosed invention provides a hinged trigger guard.

The presently disclosed invention separately provides a trigger guard that optionally allows a user to pivot the trigger guard away from the trigger guard aperture of a firearm.

The presently disclosed invention separately provides a trigger guard that optionally allows a user to provide less restricted access to the trigger guard aperture of a firearm.

The presently disclosed invention separately provides a trigger guard that can be easily manipulated by a user.

The presently disclosed invention separately provides a trigger guard that can be easily fitted or retrofitted to a firearm.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

BRIEF DESCRIPTION OF THE SEVERAL VIEWS OF THE DRAWINGS

As detailed exemplary embodiments of the present invention are disclosed herein, it is to be understood that the disclosed embodiments are merely exemplary of the invention that may be embodied in various and alternative forms, within the scope of the present invention. The accompanying drawing figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
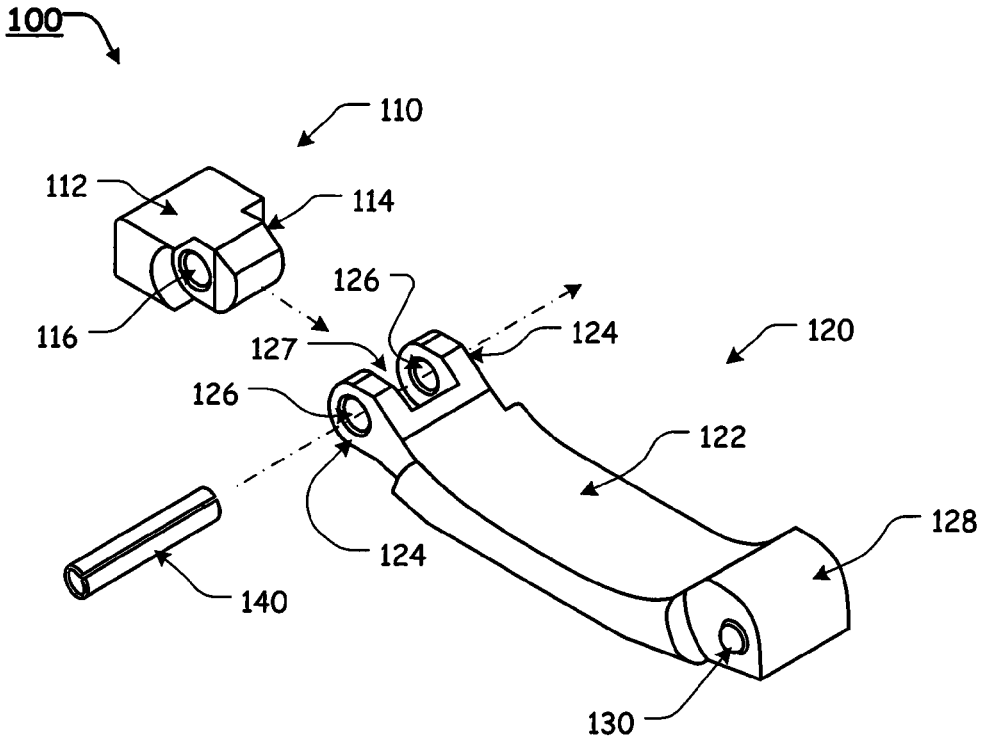
FIG. 1 illustrates an exploded perspective view of a first exemplary embodiment of certain components of a hinged trigger guard, according to this invention.
Figure 2:
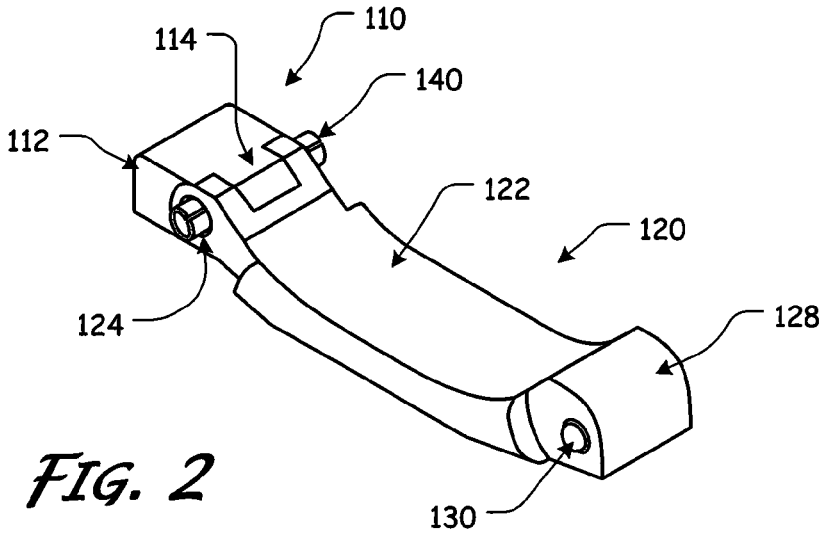
FIG. 2 illustrates a perspective view of a first exemplary embodiment of a hinged trigger guard, according to this invention.
Figure 3:
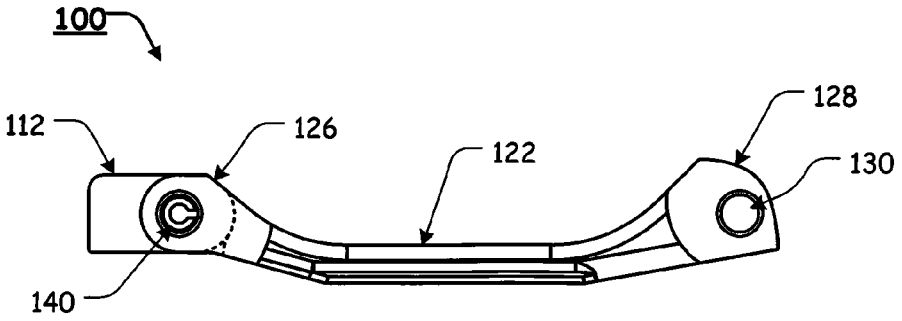
FIG. 3 illustrates a side view of a first exemplary embodiment of a hinged trigger guard, according to this invention.
Figure 4:
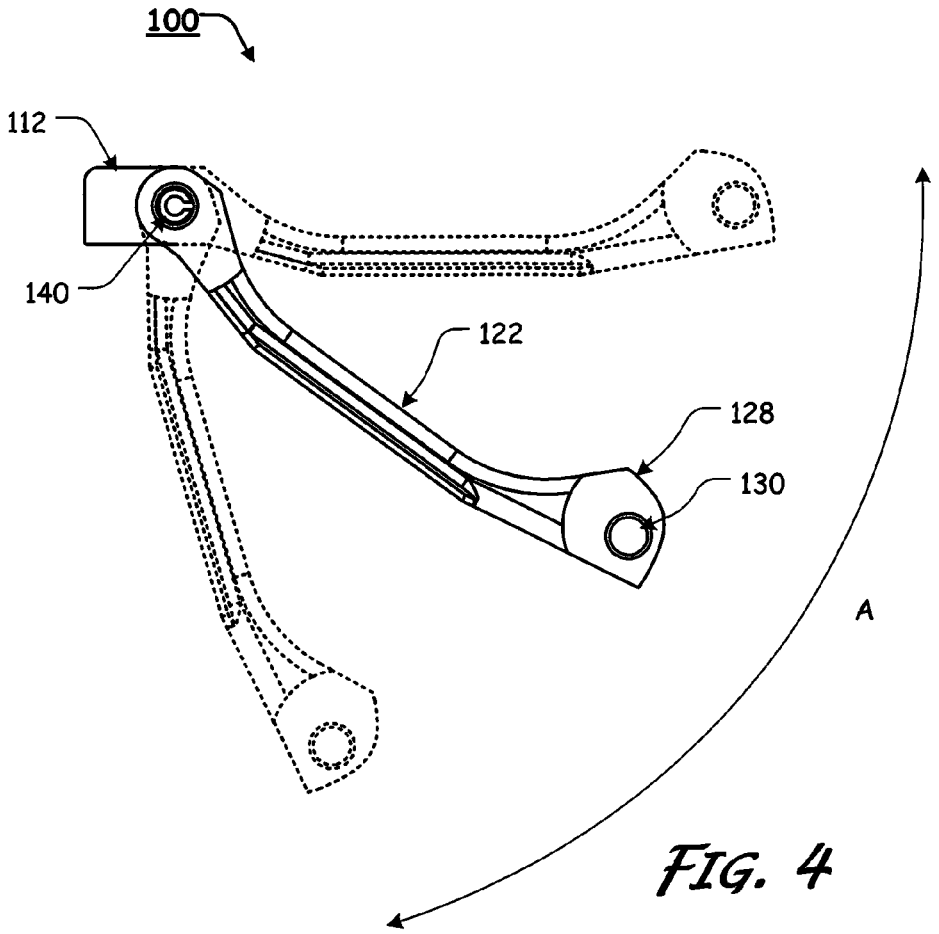
FIG. 4 illustrates a side view of a first exemplary embodiment of a hinged trigger guard of the present invention, wherein the extension member is pivoted relative to the base member, according to this invention.
Figure 5:
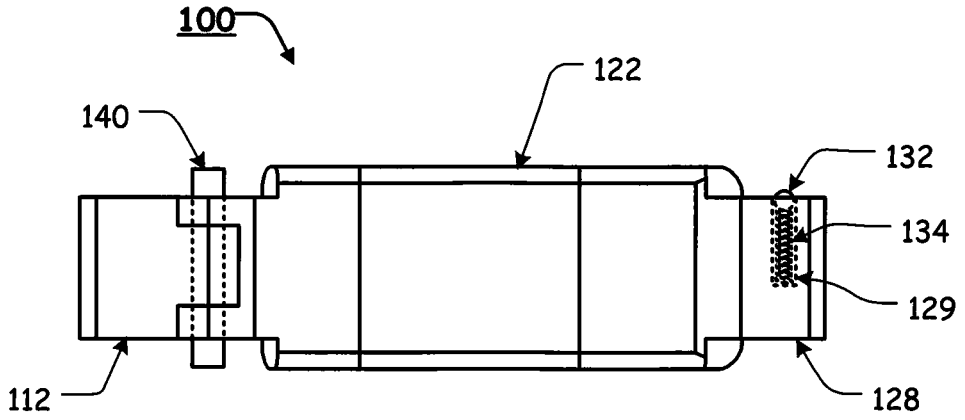
FIG. 5 illustrates a bottom view of a first exemplary embodiment of a hinged trigger guard of the present invention, wherein the ball plunger of this invention is illustrated in an extended position.
Figure 6:
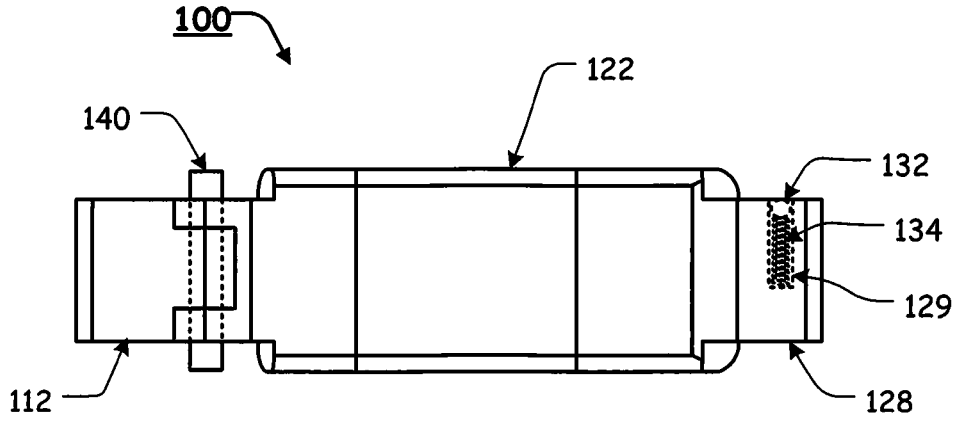
FIG. 6 illustrates a bottom view of a first exemplary embodiment of a hinged trigger guard of the present invention, wherein the ball plunger of this invention is illustrated in a retracted position.

For simplicity and clarification, the design factors and operating principles of the trigger guard according to this invention are explained with reference to various exemplary embodiments of a trigger guard according to this invention. The basic explanation of the design factors and operating principles of the trigger guard is applicable for the understanding, design, and operation of the trigger guard of this invention. It should be appreciated that the trigger guard can be adapted to many applications where two or more components are attached or coupled together using pins.

It should also be appreciated that the terms "AR-15", "firearm", and "trigger guard" are used for basic explanation and understanding of the operation of the systems, methods, and apparatuses of this invention. Therefore, the terms "AR-15", "firearm", and "trigger guard" are not to be construed as limiting the systems, methods, and apparatuses of this invention. Thus, the terms "AR-15" and "firearm" are to be understood to broadly include any firearm and the term "trigger guard" is to be understood to broadly include any guard that protects a trigger, button, or other actuator from being inadvertently manipulated.

For simplicity and clarification, the trigger guard of this invention will be described as being used to attach or coupled an AR-15 lower receiver. However, it should be appreciated that these are merely exemplary embodiments of the trigger guard and are not to be construed as limiting this invention. Thus, the trigger guard of this invention may be utilized to attach or coupled components of any firearm or device.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Turning now to the drawing Figs., FIGS. 1-6 illustrate certain elements and/or aspects of a first exemplary embodiment of a hinged trigger guard 100, according to this invention. FIGS. 7-10 illustrate the hinged trigger guard 100 being utilized in conjunction with certain elements and/or aspects of a known, exemplary AR-15 lower receiver 150, having a trigger guard aperture 152 and a pistol grip 160.

It should also be appreciated that a more detailed explanation of the components of the lower receiver 150, trigger guard aperture 152, and a pistol grip 160, instructions regarding methods for attaching the hinged trigger guard 100 to the lower receiver 150, methods for removing the hinged trigger guard 100 from the lower receiver 150, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and implement the hinged trigger guard 100, as described herein.

In illustrative, non-limiting embodiment(s) of this invention, as illustrated in FIGS. 1-6, the hinged trigger guard 100 of the present invention comprises at least some of a first or base member 110 and a second or extension member 120, wherein the extension member 120 is pivotably attached, via a pivot/installation pin 140, to the base member 110.

In various exemplary, non-limiting embodiments, the base member 110 includes a base member body portion 112 and a base member projection 114 that extends from the base member body portion 112. In certain exemplary embodiments, the base member projection 114 has a width that is less than a width of the base member body portion 112.

The base member 110 is formed so that at least a portion of the base member 110 can be fitted within the recess formed between the ears located towards the rear of a trigger guard aperture of a firearm's lower receiver. In certain exemplary, non-limiting embodiments, the base member 110 is formed so that the entire base member 110 is fitted within the lower receiver recess, as most clearly illustrated in FIGS. 9 and 10.

A base member aperture 116 is formed through the base member projection 114. The base member aperture 116 is sized so as to receive the pivot/installation pin 140 therethrough. It should be appreciated that the degree of frictional fit between the pivot/installation pin 140 and the base member aperture 116 may dictate the ease with which the extension member 120 pivots relative to the base member 110.

The extension member 120 includes an extension member body portion 122 and two ears 124. Each of the ears 124 extends from the extension member body portion 122 such that an extension member recess 127 is defined between at least a portion of the ears 124. The extension member recess 127 is formed so that the base member projection 114 is capable of being received within at least a portion of the extension member recess 127.

An extension member aperture 126 is formed through each of the ears 124. The extension member apertures 126 are aligned such that the pivot/installation pin 140 can extend through both of the extension member apertures 126. Thus, the extension member 120 can be pivotably attached to the base member 110 when, as illustrated in FIGS. 2-10, the base member aperture 116 is aligned between the extension member apertures 126 and the pivot/installation pin 140 is positioned within the aligned extension member apertures 126 and base member aperture 116.

An extension member projection 128 extends from the extension member body portion 122. The extension member projection 128 is formed so that at least a portion of the extension member projection 128 can be fitted within the recess formed between the ears located towards the front of a trigger guard aperture of a firearm's lower receiver. Typically, the extension member projection 128 extends from one end of the extension member body portion 122 while the ears 124 extend from an opposite end of the extension member body portion 122.

In certain exemplary embodiments, various components of the hinged trigger guard 100 are formed of aluminum. Alternate materials of construction of the various components of the hinged trigger guard 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the hinged trigger guard 100 is a design choice based on the desired appearance, strength, and functionality of the hinged trigger guard 100.

It should be appreciated that certain elements of the hinged trigger guard 100 may be formed as an integral unit (such as, for example, the extension member 120). Alternatively, suitable materials can be used and sections or elements made independently and attached or coupled together, such as by adhesives, welding, screws, rivets, pins, or other fasteners, to form the various elements of the hinged trigger guard 100.

It should also be understood that the overall size and shape of the hinged trigger guard 100, and the various portions thereof, is a design choice based upon the desired functionality, appearance, and/or compatibility of the hinged trigger guard 100.

In various exemplary, non-limiting embodiments, the hinged trigger guard 100 further comprises a ball plunger 130 extending from the extension member projection 128, and generally extending from a side wall of the extension member projection 128. In various exemplary embodiments, the ball plunger 130 comprises a ball 132 and a spring biasing element 134. The spring biasing element 134 is maintained within a recess 129 formed in the extension member projection 128 and the spring biasing element 134 provides a biasing force to the ball 132.

When the hinged trigger guard 100 is installed on an AR-15 or other platform, base member 110 is at least partially fitted within the recess formed between the ears located towards the rear of a trigger guard aperture of a lower receiver. The pivot/installation pin 140 interacts with an aperture formed through the ears of the lower receiver, in a manner that is not unlike the installation of a typical trigger guard. Once the base member 110 and extension member 120 are positioned by the pivot/installation pin 140, the extension member 120 can be pivoted through an arc A, as illustrated most clearly in FIGS. 8 and 10.

Figure 7:
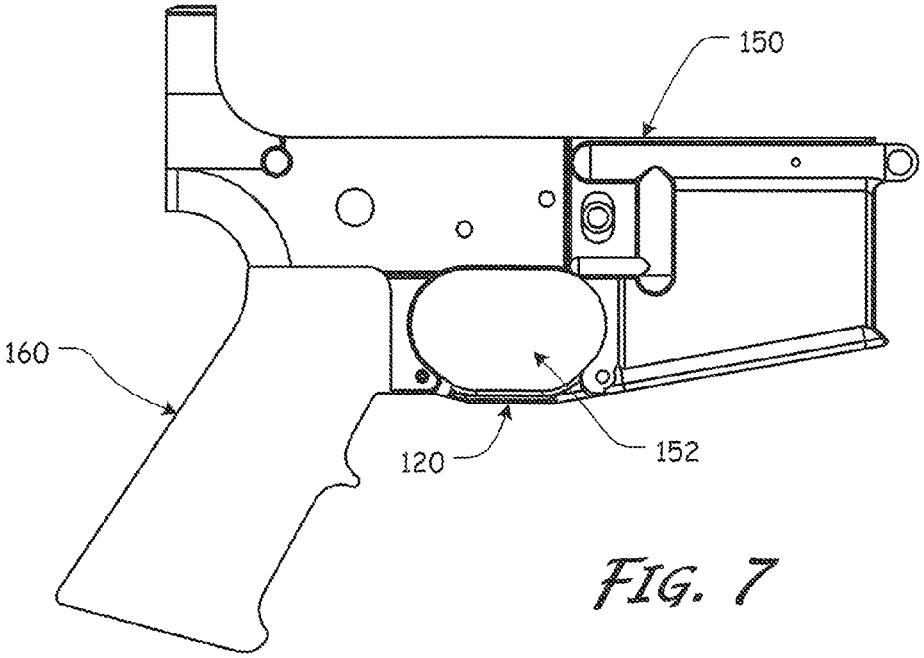
FIG. 7 illustrates a side view of a first exemplary embodiment of a hinged trigger guard of the present invention, wherein the hinged trigger guard is installed on a lower receiver of a firearm and is in a normal position.
Figure 9:
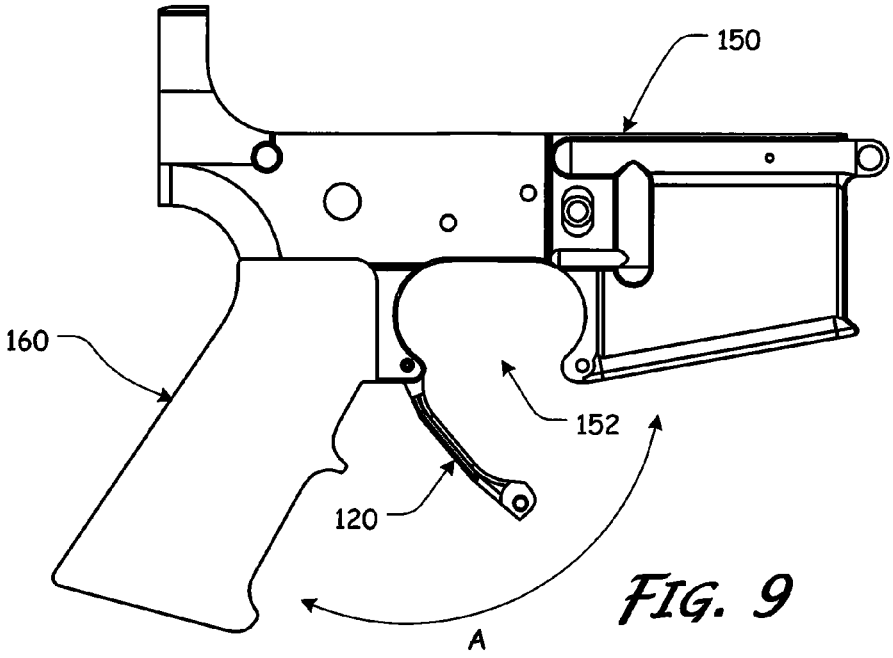
FIG. 9 illustrates a side view of a first exemplary embodiment of a hinged trigger guard of the present invention, wherein the hinged trigger guard is installed on a lower receiver of a firearm and is in a pivoted or partially pivoted position.

When the extension member 120 is pivoted toward a closed position, as illustrated in FIGS. 7 and 9, the ball 132 of the ball plunger 130 encounters an ear of the lower receiver and, as the extension member 120 is pivoted further, the spring bias of the spring biasing element 134 is overcome and the ball 132 is urged further into the recess 129.

The ball 132 remains in a retracted position until encounters an aperture or detent formed in one of the ears located towards the front of the trigger guard aperture of the lower receiver. Upon encountering the detent, the spring bias of the spring biasing element 134 urges the ball 132 at least partially into the detent. Thereby maintaining the extension member 120 in the closed position.

Figure 8:
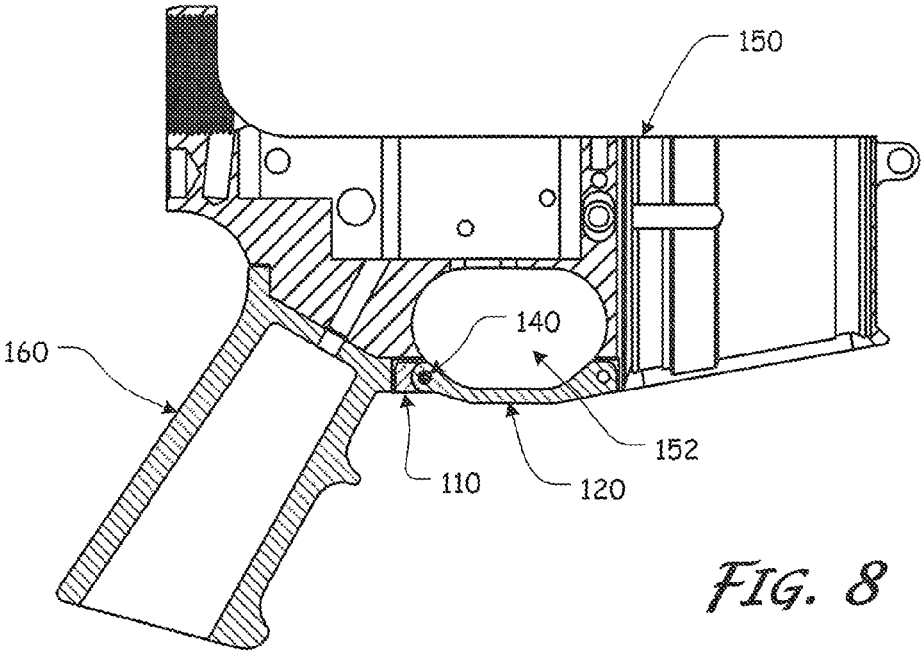
FIG. 8 illustrates a cross-sectional side view of a first exemplary embodiment of a hinged trigger guard of the present invention, wherein the hinged trigger guard is installed on a lower receiver of a firearm and is in a normal position.
Figure 10:
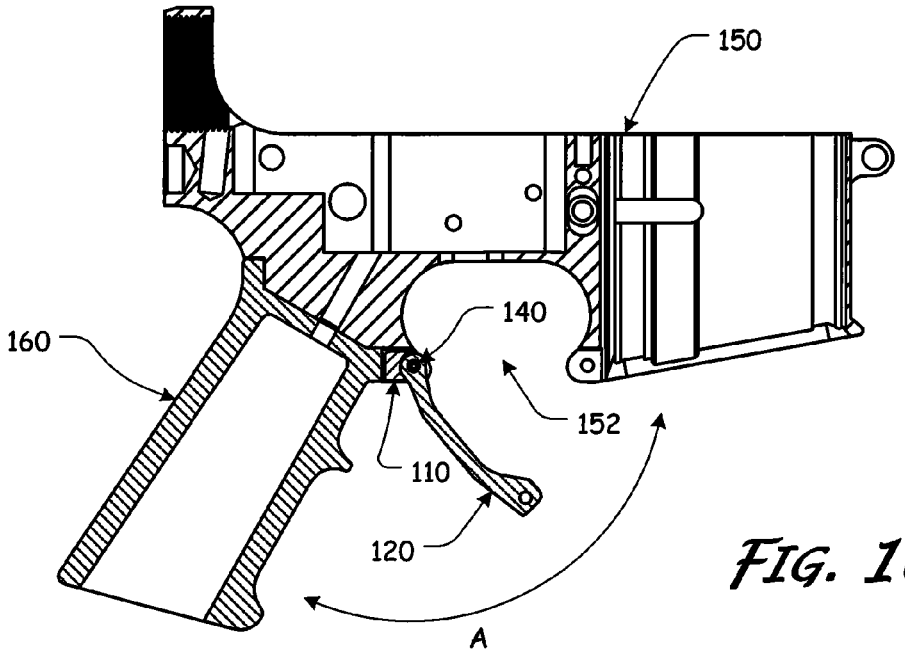
FIG. 10 illustrates a cross-sectional side view of a first exemplary embodiment of a hinged trigger guard of the present invention, wherein the hinged trigger guard is installed on a lower receiver of a firearm and is in a pivoted or partially pivoted position.

To pivot the extension member 120 to the open position, as illustrated in FIGS. 8 and 10, a downward or opening force is applied at a forward portion of the extension member 120 until the spring bias spring biasing element 134 is overcome and the ball 132 is released from the detent.

When the extension member 120 is pivotably attached to the base member 110, the degree of pivot or range of movement of the extension member 120 relative to the base member 110 is limited by interaction of the base member projection 114 and the extension member recess 127.

Figure 11:
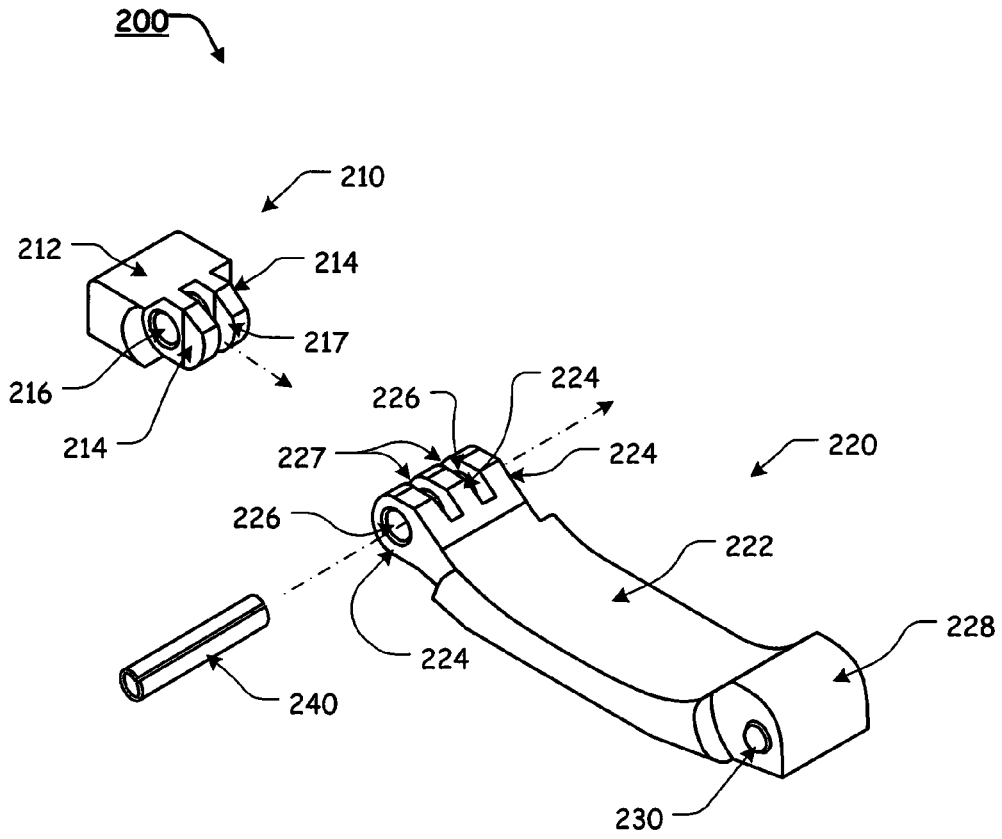
FIG. 11 illustrates an exploded perspective view of a second exemplary embodiment of certain components of a hinged trigger guard, according to this invention.

FIG. 11 illustrates an exploded perspective view of a second exemplary embodiment of certain components of a hinged trigger guard 200, according to this invention. As shown in FIG. 11, the hinged trigger guard 200 comprises at least some of a first or base member 210, a base member body portion 212, a base member projection 214, a base member aperture 216, a second or extension member 220, an extension member body portion 222, ears 224, an extension member aperture 226, an extension member recess 227, an extension member projection 228, a recess 229, a ball plunger 230, a ball 232, a spring biasing element 234, and a pivot/installation pin 240.

It should be understood that each of these elements corresponds to and operates similarly to the first or base member 110, the base member body portion 112, the base member projection 114, the base member aperture 116, the second or extension member 120, the extension member body portion 122, ears 124, the extension member aperture 126, the extension member recess 127, the extension member projection 128, the recess 129, the ball plunger 130, the ball 132, the spring biasing element 134, and the pivot/installation pin 140, as described above with reference to the hinged trigger guard 100 of FIGS. 1-10.

However, as shown in FIG. 11, the base member 210 includes two base member projections 214, with a base member recess 217 defined are formed between the base member projections 214. In addition, the extension member 220 includes three ears 224 extending therefrom, and defining to extension member recesses 227.

As the components of the hinged trigger guard 200 are assembled, the base member projections 214 fit within corresponding extension member recesses 227 and the ears 224 fit within the base member recess 217.

It should be appreciated that the number of base member projections and ears (and corresponding extension member recesses and base member recesses) is a design choice based on the desired appearance, strength, and functionality of the hinged trigger guard.

While the hinged trigger guard has been described as having one or more base member projections extending from the base member body and extension member ears extending from the extension member body, it should be appreciated that this configuration is and may be reversed in certain embodiments. Therefore, in certain exemplary, nonlimiting embodiments, the base member projection(s) and the ears are positioned such that at least one base member projection extends from the extension member body of the extension member and extension member ears extend from the base member body of the base member.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

It is also noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A hinged trigger guard for a receiver, the receiver having a rear trigger guard portion, said hinged trigger guard comprising:

a base member comprising a base member body portion, wherein said base member body portion is adapted to be at least partially received within said rear trigger guard portion, and wherein said base member is adapted to be non-pivotably attached within said rear trigger guard portion;

a base member projection extending from said base member body portion, wherein a base member aperture is formed through said base member projection;

an extension member comprising an extension member body portion;

two ears, wherein each of said ears extends from said extension member body portion, wherein an extension member recess is defined between said ears, wherein said base member projection is capable of being received within at least a portion of said extension member recess, and wherein an extension member aperture is formed through each of said ears; and an extension member projection extending from said extension member body portion;

wherein said extension member is pivotably attached to said base member when said base member aperture is aligned between said extension member apertures and a pivot/installation pin is positioned within said aligned extension member apertures and said base member aperture, such that said extension member is pivotable relative to said base member.

2. The hinged trigger guard of claim 1, wherein said extension member projection extends from an end of said extension member body portion and said ears extend from an opposite end of said extension member body portion.

3. The hinged trigger guard of claim 1, further comprising a ball plunger extending from said extension member projection.

4. The hinged trigger guard of claim 3, wherein said ball plunger comprises a ball and a spring biasing element, wherein said spring biasing element is maintained within a recess formed in said extension member projection, and wherein said spring biasing element provides a biasing force to said ball.

5. The hinged trigger guard of claim 1, further comprising a ball plunger extending from a side wall of said extension member projection.

6. The hinged trigger guard of claim 1, wherein a degree of pivot of said extension member relative to said base member is limited by interaction of said base member projection and said extension member recess.

7. A hinged trigger guard, comprising:

a base member comprising a base member body portion, wherein said base member body portion is adapted to be at least partially received within a rear trigger guard portion of a receiver, and wherein said base member is adapted to be nonpivotably attached within said rear trigger guard portion;

at least one base member projection extending from said base member body portion, wherein a base member aperture is formed through said base member projection (s);

an extension member comprising an extension member body portion;

at least two ears, wherein each of said ears extends from said extension member body portion, wherein at least one extension member recess is defined between said ears, wherein each of said base member projections is capable of being received within at least a portion of said extension member recess(es), and wherein an extension member aperture is formed through each of said ears; and an extension member projection extending from said extension member body portion;

wherein said extension member is pivotably attached to said base member when said base member aperture is aligned between said extension member apertures and a pivot/installation pin is positioned within said aligned extension member apertures and base member aperture, such that said extension member is pivotable relative to said base member.

8. The hinged trigger guard of claim 7, wherein said extension member projection extends from an end of said extension member body portion and said ears extend from an opposite end of said extension member body portion.

9. The hinged trigger guard of claim 7, further comprising a ball plunger extending from said extension member projection.

10. The hinged trigger guard of claim 9, wherein said ball plunger comprises a ball and a spring biasing element, wherein said spring biasing element is maintained within a recess formed in said extension member projection, and wherein said spring biasing element provides a biasing force to said ball.

11. The hinged trigger guard of claim 7, further comprising a ball plunger extending from a side wall of said extension member projection.

12. The hinged trigger guard of claim 7, wherein a degree of pivot of said extension member relative to said base member is limited by interaction of said base member projection (s) and said extension member recess(es).

13. A hinged trigger guard for a receiver, the receiver having a rear trigger guard portion, said hinged trigger guard comprising:

a base member comprising a base member body portion, wherein said base member body portion is adapted to be at least partially received within said rear trigger guard portion, and wherein said base member is adapted to be non-pivotably attached within said rear trigger guard portion;

two ears, wherein each of said ears extends from said base member body portion, wherein a recess is defined between said ears, and wherein a base member aperture is formed through each of said ears;

an extension member comprising an extension member body portion;

a first extension member projection extending from said extension member body portion, wherein an extension member aperture is formed through said first extension member projection, and wherein said first extension member projection is capable of being received within at least a portion of said recess;

a second extension member projection extending from said extension member body portion;

wherein said extension member is pivotably attached to said base member when said extension member aperture is aligned between said base member apertures and a pivot/installation pin is positioned within said aligned base member apertures and extension member aperture, such that said extension member is pivotable relative to said base member.

14. The hinged trigger guard of claim 13, wherein said first extension member projection extends from an end of said extension member body portion and said second extension member projection extends from an opposite end of said extension member body portion.

15. The hinged trigger guard of claim 13, further comprising a ball plunger extending from said second extension member projection.

16. The hinged trigger guard of claim 15, wherein said ball plunger comprises a ball and a spring biasing element, wherein said spring biasing element is maintained within a recess formed in said extension member projection, and wherein said spring biasing element provides a biasing force to said ball.

17. The hinged trigger guard of claim 13, further comprising a ball plunger extending from a side wall of said second extension member projection.

18. The hinged trigger guard of claim 13, wherein a degree of pivot of said extension member relative to said base member is limited by interaction of said first extension member projection and said recess.

* * * * *